US008216034B1

(12) United States Patent
Sona et al.

(10) Patent No.: US 8,216,034 B1
(45) Date of Patent: Jul. 10, 2012

(54) UNIVERSAL AIR VENT COVER SYSTEM

(76) Inventors: Arlene Sona, Union, NJ (US); Scott Herter, Old Bridge, NJ (US)

( * ) Notice: Subject to any disclaimer, the term of this patent is extended or adjusted under 35 U.S.C. 154(b) by 888 days.

(21) Appl. No.: 12/291,172

(22) Filed: Nov. 7, 2008

Related U.S. Application Data

(63) Continuation-in-part of application No. 11/268,307, filed on Nov. 7, 2005.

(51) Int. Cl.
*F24F 13/08* (2006.01)

(52) U.S. Cl. ..... 454/284; 454/276; 454/275; 454/289; 454/330

(58) Field of Classification Search ..... 454/243, 454/265, 270–292, 330–332
See application file for complete search history.

(56) References Cited

U.S. PATENT DOCUMENTS

| | | | | | |
|---|---|---|---|---|---|
| 124,663 | A | * | 3/1872 | Bunce et al. | 454/331 |
| 1,142,792 | A | * | 6/1915 | Bailey | 49/51 |
| 1,279,739 | A | * | 9/1918 | Merril | 138/37 |
| 2,336,765 | A | | 12/1943 | Adams | |
| 2,765,949 | A | * | 10/1956 | Hillman | 220/835 |
| 4,587,892 | A | * | 5/1986 | Witten et al. | 454/276 |
| 4,699,045 | A | * | 10/1987 | Hensley | 454/313 |
| 6,030,427 | A | * | 2/2000 | Sorice et al. | 55/480 |
| 6,234,893 | B1 | | 5/2001 | Meredith | |
| 6,257,976 | B1 | | 7/2001 | Richardson, III | |
| 6,309,297 | B1 | | 10/2001 | Berger | |
| 6,354,936 | B1 | * | 3/2002 | Noh et al. | 454/201 |
| 6,379,412 | B1 | | 4/2002 | Porterfield | |
| 6,468,054 | B1 | * | 10/2002 | Anthony et al. | 417/360 |
| 6,604,994 | B2 | | 8/2003 | Achen | |
| 6,712,889 | B2 | * | 3/2004 | Pillion et al. | 96/418 |
| 7,192,074 | B2 | * | 3/2007 | DePue et al. | 296/37.9 |
| 2004/0003718 | A1 | | 1/2004 | Milano | |

* cited by examiner

*Primary Examiner* — Steven B McAllister
*Assistant Examiner* — Jamil Decker
(74) *Attorney, Agent, or Firm* — Emery L. Tracy

(57) ABSTRACT

An air vent cover system for mounting within a duct has a pair of side walls, a top wall, and a bottom wall. The air vent cover system comprises a housing with an opening. A tensioning mechanism releasably maintains the housing within the duct by applying an outward force on two opposite walls of the duct causing the other two opposite walls to move inward against the housing. A non-pivoting, stationary grate is secured to the housing with the stationary grate having horizontal and vertical bars and the bars spaced from each other to maintain a child-sized hand from going between the bars. A cover grate is pivotally mounted to the housing and has a plurality of semi-circular slits for allowing maximum amount of air to pass therethrough. A latching mechanism secured to the housing and cooperating with the cover grate releasably maintains the cover grate against the housing.

12 Claims, 7 Drawing Sheets

UNIVERSAL AIR VENT COVER SYSTEM

The present application is a continuation-in-part of pending patent application Ser. No. 11/268,307, filed on Nov. 7, 2005, entitled "Universal Intake Air Vent".

BACKGROUND OF THE INVENTION

1. Field of the Invention

This invention relates generally to an air vent cover system and, more particularly, the invention relates to a new and improved air vent cover system for use in a residential or commercial structure.

2. Description of the Prior Art

U.S. Pat. No. 6,030,427, issued to Sorice, discloses a replacement air filter for a heating and air conditioning system inserted into a register that is pivotally attachable to a duct using a hinge and having a magnetic closure.

U.S. Pat. No. 6,234,893, issued to Meredithy, discloses a vent assembly for an air supply system having a housing and slot for holding a filter.

U.S. Pat. No. 6,309,297, issued to Berger, discloses an air register and filter assembly having a faceplate that can be replaced without the need of tools.

SUMMARY

The present invention is an air vent cover system for mounting within a duct. The duct has a pair of side walls, a top wall substantially perpendicular to the side walls, and a bottom wall substantially perpendicular to the side walls. The air vent cover system comprises a housing with an opening formed in the housing. A tensioning mechanism releasably maintains at least a portion of the housing within the duct with the tensioning mechanism applying an outward force on two opposite walls of the duct causing the other two opposite walls to move in a general direction inward against the housing. A non-pivoting, stationary grate is secured to the housing with the stationary grate having a plurality of horizontal and vertical bars and the bars spaced from each other a sufficient distance to maintain a child-sized hand from going between the bars. A cover grate is pivotally mounted to the housing with the cover grate having a plurality of slits for allowing air to pass therethrough. A plurality of semi-circular slits allow maximum amount of air to pass therethrough not limited by horizontal bars and vertical louvers. A latching mechanism secured to the housing and cooperating with the cover grate releasably maintains the cover grate against the housing. A magnetic latching system allows easy access to the filter, restrictor, and block off plates especially with consideration for people with paralysis or handicapped that cannot pry open snap latches.

In addition, the present invention is an air vent cover system for use in residential or commercial structures. The air vent cover system is designed to be placed within a duct with the a magnetic latch for releasably securing a cover grate against a housing. Furthermore, the air vent cover system has trapezoidal side walls so as not to restrict air flow, an air filter slidable into the cover grate, and two pairs of tensioners for releasably securing the air vent housing into the duct.

There has thus been outlined, rather broadly, the more important features of an intake air vent and cover that the detailed description thereof that follows may be better understood and in order that the present contribution to the art may be better appreciated. There are, of course, additional features of the air vent and cover that will be described hereinafter and which will form the subject matter of the claims appended hereto.

In this respect, before explaining at least one embodiment of the air vent and cover in detail, it is to be understood that the air vent and cover is not limited in its application to the details of construction and to the arrangements of the components set forth in the following description or illustrated in the drawings. The air vent and cover is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present air vent and cover. It is important, therefore, that the claims be regarded as including such equivalent constructions insofar as they do not depart from the spirit and scope of the present invention.

It is therefore an object of the present invention to provide an air vent and cover which has all of the advantages of the prior art and none of the disadvantages.

It is another object of the present invention to provide an air vent and cover which may be easily and efficiently manufactured and marketed.

It is another object of the present invention to provide an air vent and cover which is of durable and reliable construction.

It is yet another object of the present invention to provide an air vent and cover which is economically affordable and available for relevant market segment of the purchasing public.

Other objects, features and advantages of the present invention will become more readily apparent from the following detailed description of the preferred embodiment when considered with the attached drawings and appended claims.

DETAILED DESCRIPTION OF THE PREFERRED EMBODIMENTS

Figure 6:
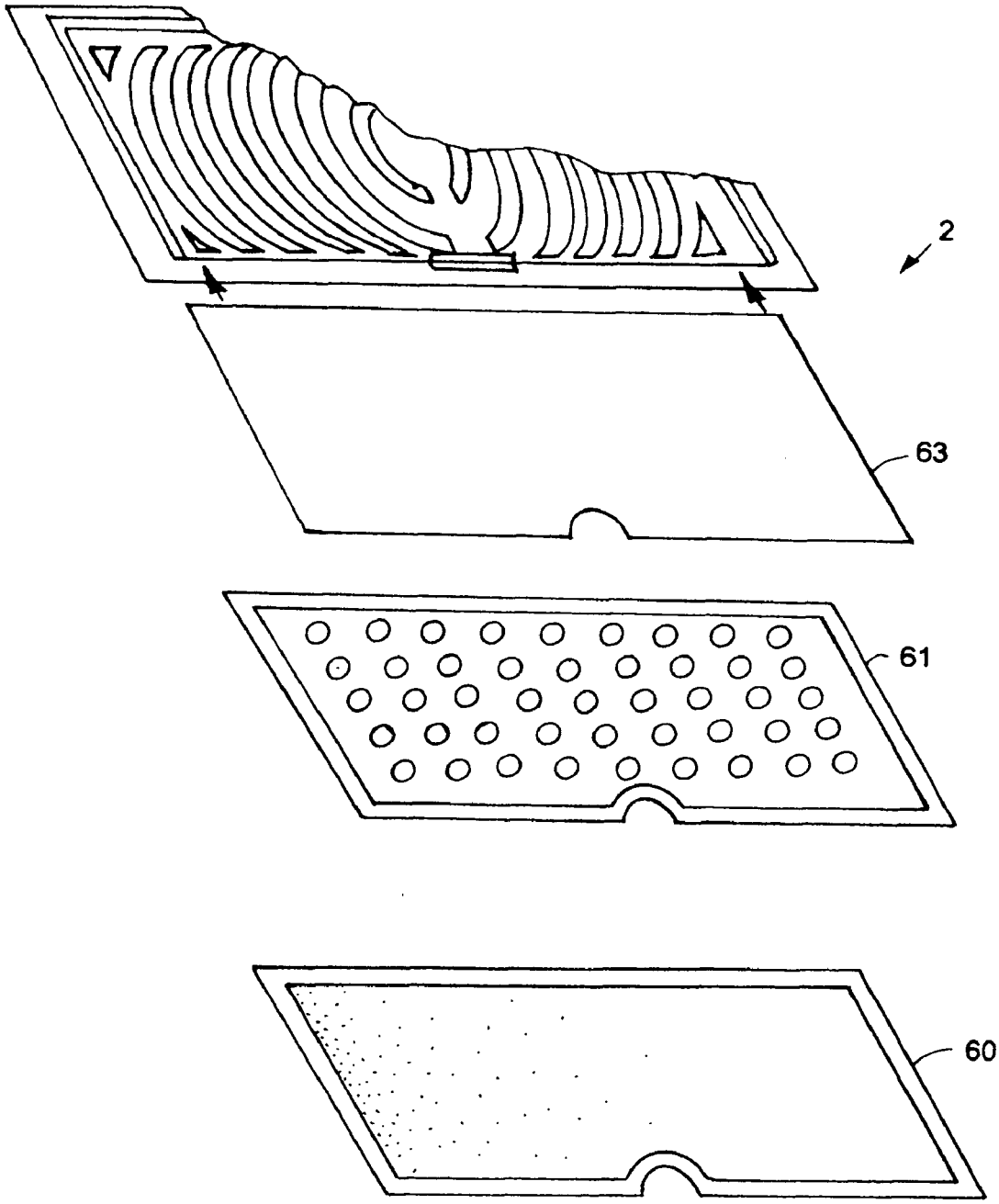
FIG. 6 is an exploded perspective view illustrating the air vent cover, constructed in accordance with the present invention, with a restrictor plate and a filter slidably mountable within the cover grate.
Figure 7:
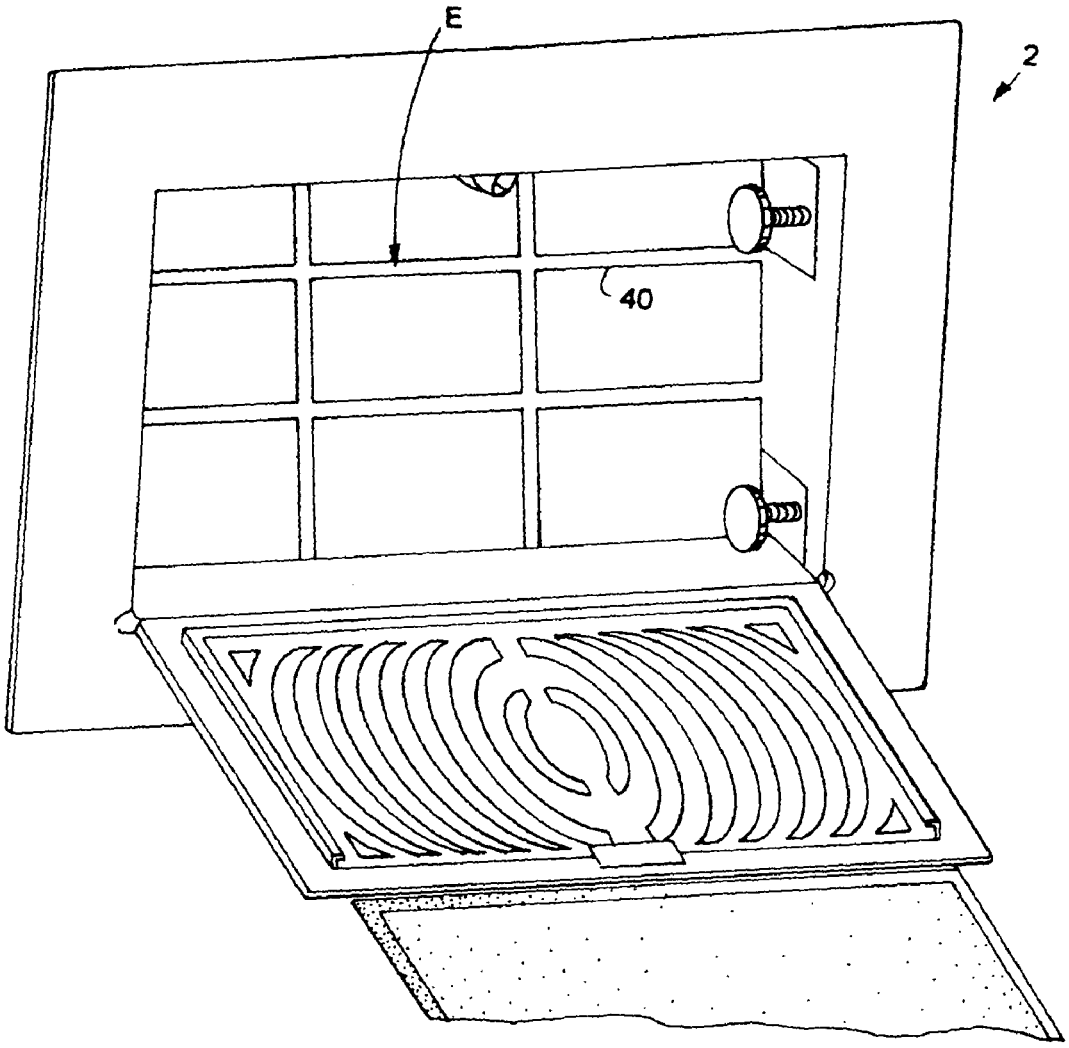
FIG. 7 is a perspective view illustrating the air vent cover, constructed in accordance with the present invention, with a childproof stationary grate mounted within the housing.
Figure 8:
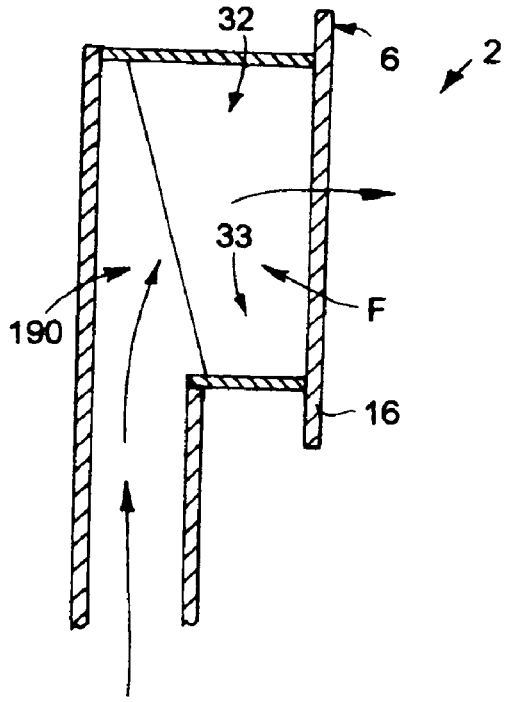
FIG. 8 is a sectional side view illustrating the air vent cover, constructed in accordance with the present invention, with trapezoidal side walls allowing full air flow through the air vent cover.

As illustrated in FIGS. 1-8, 10, and 11, the present invention is an air vent cover system, indicated generally at 2, illustrating the cover grate 4 in a lowered position, while FIG. 8 illustrates a sectional side view of the air vent cover system 2 and cover grate 4 with the cover grate 4 in a raised position. The air vent cover system 2 itself comprises a housing 5 having an outer frame 6 with the housing 5 being designed to be placed into a venting hole of a duct within a room in a commercial or residential structure. It should be noted that the air vent cover system 2 can be used for both air intakes and air exhausts. The outer frame 6 of the housing 5 has artistic value only and any type of outer frame 6 is within the scope of the present invention.

The housing 5 further comprises a left side piece 8, a right side piece 10, a top piece 12, and a bottom piece 14. The top piece 12 and the bottom piece 14 each have two ends, a left end and a right end, and furthermore, each has two surfaces, an inner surface and an outer surface. The left side piece 8 and the right side piece 10 each have two ends, a top end and a bottom end, and furthermore, each has two surfaces, an inner surface and an outer surface. The left end of the top piece 12 is attached to the top end of the left side piece 8, while the right end of the top piece 12 is attached to the top end of the right side piece 10. Furthermore, the left end of the bottom piece 14 is attached to the bottom end of the left side piece 8, while the right end of the bottom piece 14 is attached to the bottom end of the right side piece 10. Finally, the left side piece 8, a right side piece 10, a top piece 12, a bottom piece 14 each have two edges, a front edge and a rear edge.

Figure 9:
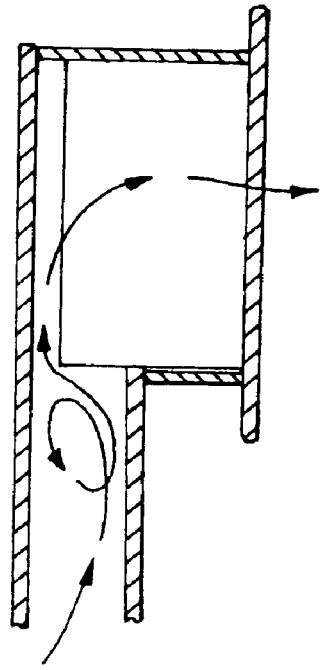
FIG. 9 is a sectional side view illustrating a prior art air vent cover without trapezoidal side walls showing constricted air flow.

Both the left side piece 8 and the right side piece 10 are substantially trapezoidally shaped. The length of each both left side piece 8 and the right side piece 10 are preferably the same throughout, but the width of both the left side piece 8 and the right side piece 10 preferably increases traveling from the bottom piece 14 to the top piece 12. The length dimension of the left side piece 8 and the right side piece 10 is measured between the bottom piece 14 to the top piece 12, while the width dimension of the left side piece 8 and the right side piece 10 is measured in between the front edge and the rear edge. As best illustrated in FIG. 8, the trapezoidal side walls do not restrict or disrupt air flow through the duct as compared to a non-trapezoidal side wall, illustrated in FIG. 9.

The housing 5 is preferably a rectangular-shaped frame with two surfaces, a front surface and a rear surface, and furthermore, also has two ends, a left end and a right end, and also has two side surfaces, a top side surface and a bottom side surface. The front edge of left side piece 8, right side piece 10, top piece 12, and bottom piece 14 are fixedly attached to the rear surface of the outer frame 6.

Figure 1:
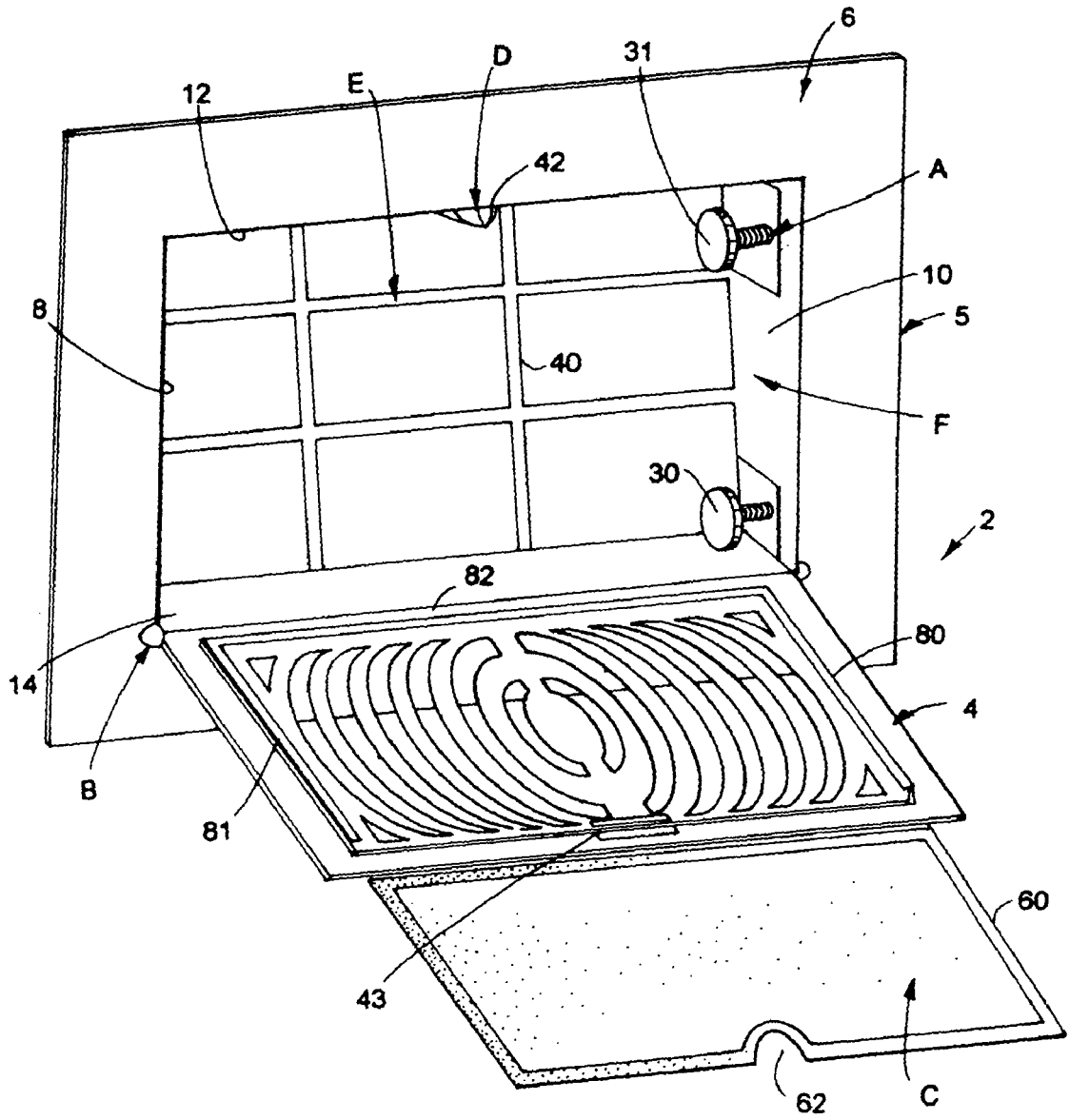
FIG. 1 is a perspective view illustrating an air vent cover, constructed in accordance with the present invention, with a cover grate of the air vent cover in a lowered position relative to a frame.
Figure 3:
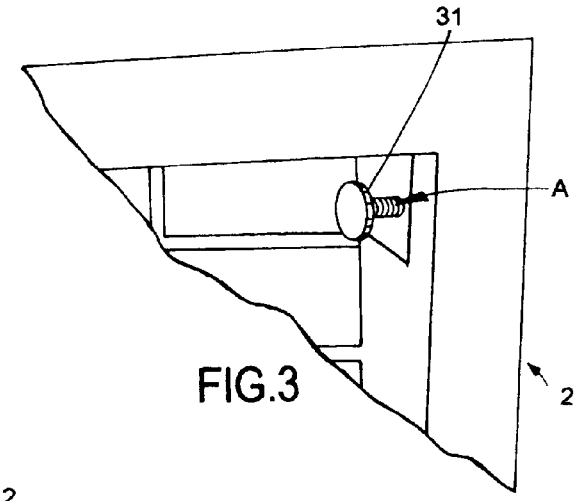
FIG. 3 is a perspective view illustrating the air vent cover, constructed in accordance with the present invention, with the tensioning mechanism releasably securing the air vent cover positioned within the duct.
Figure 2:
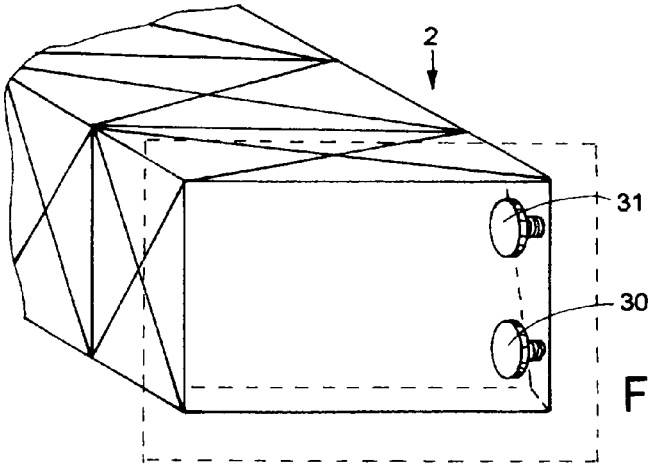
FIG. 2 is a perspective view illustrating the air vent cover, constructed in accordance with the present invention, with a tensioning mechanism releasably securing the air vent cover positioned within a duct.
Figure 4:
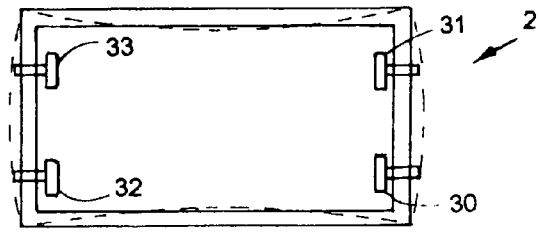
FIG. 4 is a side sectional view illustrating the air vent cover, constructed in accordance with the present invention, with the air vent cover positioned within the duct.

A pair of tensioners 30 and 31 is insertable through the right side piece 10, while a second pair of tensioners 32 and 33 is insertable through the left side piece 8. Each of the tensioners 30 either turn in and releasably lock in place or are spring loaded. The tensioners 30, 31, 32, 33 are tightenable once the air vent 2 is placed into a venting hole to maintain the air vent within the venting hole. As best illustrated in FIGS. 2-4, as the tensioners 30, 31, 32, 33 are tightened against the side walls of the duct, the top wall and the bottom wall of the duct to move in a generally inward direction against the housing 5 thereby further securing the air vent 2 within the duct.

As best illustrated in FIG. 7, a childproof grate 40 is secured to the housing 5 against the rear edge of the left side piece 8, a right side piece 10, a top piece 12, and a bottom piece 14. This grate 40 will prevent larger objects from being inserted into the duct system through the air vent and will also protect small children from inserting their hands into the duct.

Figure 5:
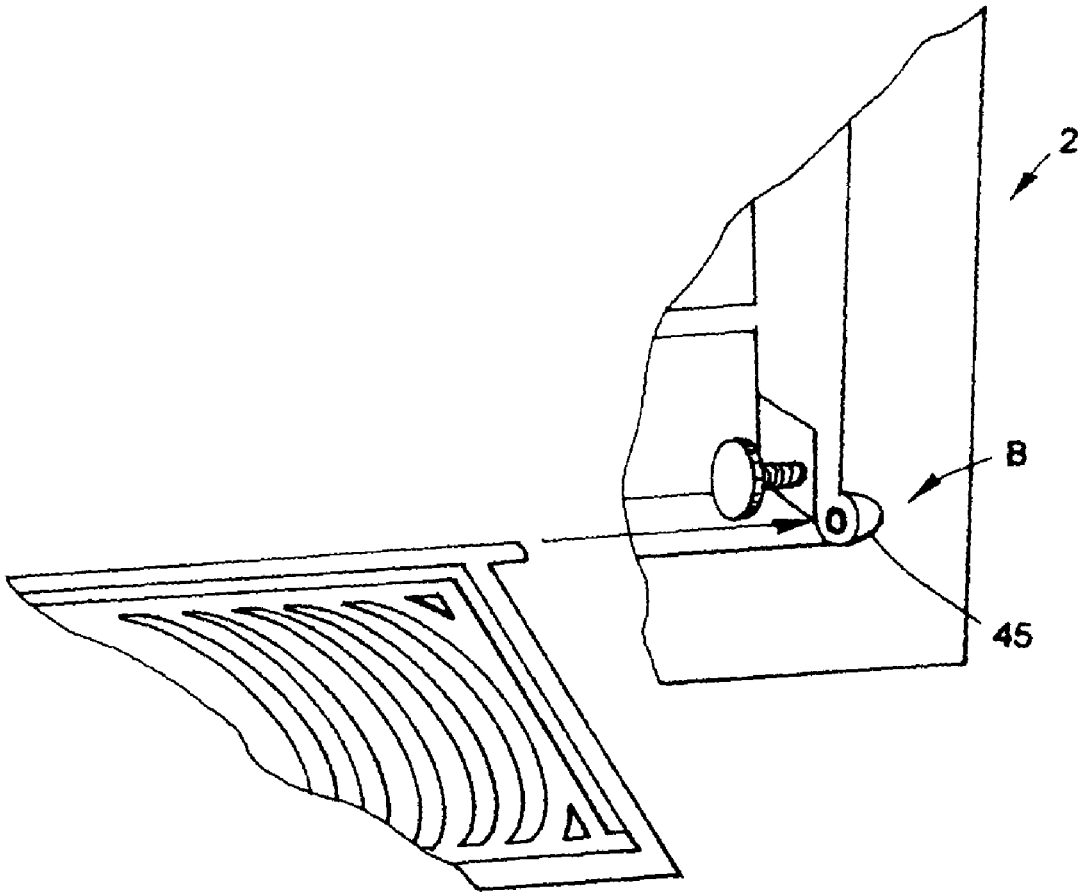
FIG. 5 is a perspective view illustrating the air vent cover, constructed in accordance with the present invention, with a ball and socket joint for pivotally mounting the cover grate to the frame.

A magnetic latch 42 is shown attached to the bottom surface of the top piece 12 about halfway between the first and second end of the top piece 12 near the front edge of the top piece 12 with a metallic strike plate 43 secured to the cover grate 4. The cover grate 4 is shown to have two surfaces, an inner surface and an outer surface, two side edges comprising a lower side edge and an upper side edge, and two ends, a left end and a right end. The cover grate 4 is preferably made of heat-resistant plastic. The lower side edge of the cover grate 4 is pivotally attached to the left side piece 8 and the right side piece 10 adjacent the bottom piece 14 a ball and socket joint 45, as best illustrated in FIG. 5, and pivots upward to the point where the upper side edge rests against the magnetic latch 42. The magnetic latch 42 releasably holds the cover grate 4 in an upright position.

An air filter 60 is shown to have two side edges comprising a lower side edge and an upper side edge, and two ends, a left end and a right end. The upper side edge of the air filter 60 has a small semi-circular cutout 62, which allows the air filter 60 to bypass the metallic strike plate. In an embodiment of the present invention, the air filter 60 can be slid within a track 80, 81, and 82 on the cover grate 4 and maintained therein.

As illustrated in FIG. 6, the air vent 2 of the present invention can further include a restrictor plate 61 for regulating airflow through the air vent 2. A variety of restrictor plates 61 can be provided depending on the amount of airflow desired. Also, a shut off plate 63 can be provided to completely shut off the airflow through the air vent 2. Both the restrictor plate and the shut off plate are receivable within the tracks on the cover grate 4.

Figure 10:
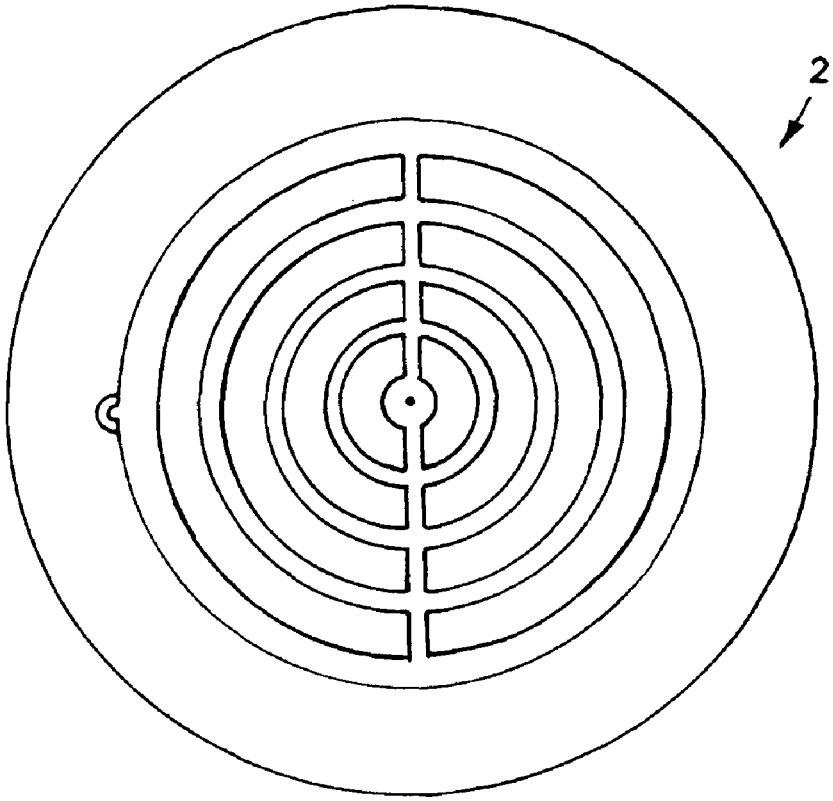
FIG. 10 is a front elevational view illustrating the air vent cover, constructed in accordance with the present invention, in a circular embodiment.
Figure 11:
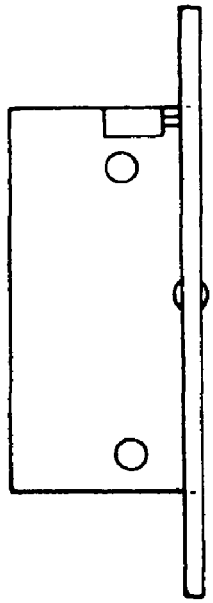
FIG. 11 is a sectional side view illustrating the air vent cover, constructed in accordance with the present invention, in the circular embodiment

As illustrated in FIGS. 10 and 11, the air vent 2 of the present invention can also be constructed in circular form. It is within the scope of the present invention to construct the air vent 2 in any shape desired.

In sum, the present invention concerns that of a new and improved air vent cover system for use in a residential or commercial structure. The air vent cover system is designed to be placed within a venting duct. The air vent cover system has a magnetic latch for holding the grate cover shut and for easy access to the filters, the restrictor, or block off plate. The cover grate is pivotally attached to the trapezoidal side walls by a ball and socket joint. The trapezoidal side walls do not restrict or disrupt air flow through the duct. The air vent cover system is releasably secured into the duct by the use of two pairs of tensioners on the trapezoidal side walls. The air vent cover system can be installed into any duct regardless of walls, beams, or any support structures. It is filtered by means of a framed filter slidable into three channels on the inside of the cover grate, i.e., a left channel, a right channel, and a bottom channel. The filter slides into the two side channels and rests within the bottom channel thereby securing the filter in place. The air vent cover system also has a restrictor plate and a shut off plate for regulating the desired amount of airflow, which slide behind the already installed filter in the channels on the inside of the cover grate. It also has a child proof grate at the rear of the housing for residential applications. The air vent cover system is designed for easy installation and removal with no tools of any kind. The whole unit can be removed in seconds for cleaning and access to the duct. The air vent cover system can be configured to any shape duct work, depending on the application, without damaging the duct work, such as duct work in warehouses, factories, and shops that hang from the ceiling with no support structures.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. An air vent cover system for mounting within a duct, the duct having a pair of side walls, a top wall substantially perpendicular to the side walls, and a bottom wall substantially perpendicular to the side walls, the air vent cover system comprising:

a housing;

an opening formed in the housing;

tensioning means for releasably maintaining at least a portion of the housing within the duct, the tensioning means applying an outward force on the two side walls of the duct causing the top wall and the bottom wall to move in a general direction inward against the housing;

a non-pivoting, stationary grate secured to the housing, the stationary grate having a plurality of horizontal and vertical bars, the bars spaced from each other a sufficient distance to maintain a child-sized hand from going between the bars;

a cover grate pivotally mounted to the housing, the cover grate having a plurality of semi-circular slits for allowing maximum amount of air to pass therethrough;

magnetic latching means secured to the housing and cooperating with a magnet striker plate on the cover grate for releasably maintaining the cover grate against the housing; and a plurality of tracks attached to the cover grate, an air filter receivable within the tracks and positioned against the slits;

wherein the plurality of tracks include a pair of parallel side tracks and a bottom track substantially perpendicular to the side tracks; and wherein the air filter has a lower side edge and an upper side edge, the air filter also having a left end and a right end, the upper side edge of the air filter having a small semi-circular cutout, thereby allowing the air filter to bypass the magnet striker plate.

2. The air vent cover system of claim 1 wherein the tensioning means includes a first pair of tensioning mechanisms extending through the housing against one of the side walls of the duct and a second pair of tensioning mechanisms extending through the housing against the other side wall of the duct, and further wherein the tensioning of the tensioning mechanisms against the side walls of the duct causes the top wall and the bottom wall of the duct to move in a generally inward direction against the housing.

3. The air vent cover system of claim 1 wherein the slits on the cover grate are vertically oriented, semi-circular openings.

4. An intake air vent cover system of claim 1 and further comprising:

an airflow restrictor plate receivable within channels on the cover grate; and a block off plate receivable within channels on the cover grate.

5. The air vent cover system of claim 1 wherein the housing has a left side piece, a right side piece, a top piece, and a bottom piece, the top piece and bottom piece each having a left end and a right end, the top piece and the bottom piece each having an inner surface and an outer surface, the left side piece and right side piece each having a top end and a bottom end, the left side piece and right side piece each having an inner surface and an outer surface, the left end of the top piece being attached to the top end of the left side piece, the right end of the top piece being attached to the top end of the right side piece, the left end of the bottom piece being attached to the bottom end of the left side piece, the right end of the bottom piece being attached to the bottom end of the right side piece, wherein the left side piece, the right side piece, the top piece, and the bottom piece each have a front edge and a rear edge.

6. The air vent cover system of claim 5 wherein the left side piece and the right side piece are trapezoidally shaped such that the stationary grate is positioned in an angled position relative to the cover grate.

7. The air vent cover system of claim 1 wherein the cover grate is pivotally mounted to the housing with a ball and socket joint, the cover grate having a pin receivable within the joint, the cover grate pivotable upward to releasably latch against the housing.

8. A method for covering a duct, the duct having a pair of side walls, a top wall substantially perpendicular to the side walls, and a bottom wall substantially perpendicular to the side walls, the method comprising:

providing a housing;

forming an opening in the housing;

releasably maintaining at least a portion of the housing within the duct by applying an outward force on the two side walls of the duct causing the top wall and the bottom wall to move in a general direction inward against the housing;

securing a non-pivoting, stationary grate to the housing, the stationary grate having a plurality of horizontal and vertical bars;

spacing the bars spaced from each other a sufficient distance to maintain a child-sized hand from going between the bars;

pivotally mounting a cover grate to the housing;

forming a plurality of semi-circular slits in the cover grate for allowing maximum amount of air to pass therethrough;

magnetically maintaining the cover grate against the housing;

attaching a plurality of tracks to the cover grate, the plurality of tracks including a pair of parallel side tracks and a bottom track substantially perpendicular to the side tracks;

inserting an air filter within the tracks and positioned against the slits, the air filter having a lower side edge and an upper side edge, the air filter also having a left end and a right end; and forming a small semi-circular cutout on the upper side edge of the air filter thereby allowing the air filter to bypass the magnet striker plate.

9. The method of claim 8 and further comprising:

securing a magnetic latch to the housing; and securing a metallic strike plate to the cover grate.

10. The method of claim 8 wherein the housing has a left side piece, a right side piece, a top piece, and a bottom piece, the top piece and bottom piece each having a left end and a right end, the top piece and the bottom piece each having an inner surface and an outer surface, the left side piece and right side piece each having a top end and a bottom end, the left side piece and right side piece each having an inner surface and an outer surface, the left end of the top piece being attached to the top end of the left side piece, the right end of the top piece being attached to the top end of the right side piece, the left end of the bottom piece being attached to the bottom end of the left side piece, the right end of the bottom piece being attached to the bottom end of the right side piece, wherein the left side piece, the right side piece, the top piece, and the bottom piece each have a front edge and a rear edge.

11. The method of claim 10 wherein the left side piece and the right side piece are trapezoidally shaped such that the stationary grate is positioned in an angled position relative to the cover grate.

12. The method of claim 8 and further comprising:

pivotally mounting the cover grate to the trapezoidal side walls in the housing with a ball and socket joint, the cover grate having a pin receivable within the joint, the cover grate pivotable upward to releasably latch against the housing.

* * * * *